US006347649B1

(12) United States Patent
Pope et al.

(10) Patent No.: US 6,347,649 B1
(45) Date of Patent: Feb. 19, 2002

(54) PRESSURE SENSOR FOR A VAPOR RECOVERY SYSTEM

(75) Inventors: Kenneth L. Pope, Walkertown; William P. Shermer, Greensboro, both of NC (US)

(73) Assignee: Marconi Commerce Systems Inc., Greensboro, NC (US)

( * ) Notice: Subject to any disclaimer, the term of this patent is extended or adjusted under 35 U.S.C. 154(b) by 0 days.

(21) Appl. No.: 09/714,238

(22) Filed: Nov. 16, 2000

(51) Int. Cl.[7] ..... B65B 31/00

(52) U.S. Cl. ..... 141/59; 141/94; 141/285; 141/301

(58) Field of Search ..... 141/45, 50, 94, 141/59, 285, 286, 301, 302

(56) References Cited

U.S. PATENT DOCUMENTS

| | | | | |
|---|---|---|---|---|
| 3,016,928 A | | 1/1962 | Brandt | 141/45 |
| 3,735,634 A | | 5/1973 | Clinton et al. | 73/64.2 |
| 4,147,096 A | | 4/1979 | Caswell | 98/122 |
| 4,166,485 A | | 9/1979 | Wokas | 141/52 |
| 4,215,565 A | | 8/1980 | Zanker | 73/30 |
| 4,508,127 A | | 4/1985 | Thurston | 137/8 |
| 4,543,819 A | | 10/1985 | Chin et al. | 73/64.2 |
| 4,566,504 A | | 1/1986 | Furrow et al. | 141/59 |
| 4,570,686 A | | 2/1986 | Devine | 141/286 |
| 4,611,729 A | | 9/1986 | Gerstenmaier et al. | 222/75 |
| 4,653,334 A | | 3/1987 | Capone | 73/863.81 |
| 4,687,033 A | | 8/1987 | Furrow et al. | 141/59 |
| 4,749,009 A | | 6/1988 | Faeth | 141/45 |
| 4,827,987 A | | 5/1989 | Faeth | 141/59 |
| 4,842,027 A | | 6/1989 | Faeth | 141/45 |
| 4,871,450 A | | 10/1989 | Goodrich et al. | 210/151 |
| 4,938,251 A | | 7/1990 | Furrow et al. | 137/269 |
| 4,967,809 A | * | 11/1990 | Faeth | 141/59 |
| 4,986,445 A | | 1/1991 | Young et al. | 222/71 |
| 5,013,434 A | | 5/1991 | Furrow | 210/232 |

(List continued on next page.)

FOREIGN PATENT DOCUMENTS

| | | |
|---|---|---|
| GB | 2316060 | 2/1998 |
| WO | WO 00/50850 | 8/2000 |

*Primary Examiner*—Timothy L. Maust
(74) *Attorney, Agent, or Firm*—Withrow & Terranova, PLLC

(57) ABSTRACT

A pressure sensor includes a pair of inputs for determining the pressure within a vapor recovery path. The inputs are positioned about a flow restrictor within the vapor recovery path. The vapor recovery path may include a mounting platform for attaching the pressure sensor and positioning the inputs relative to the flow restrictor. In one embodiment, a vapor sensor may also be positioned within the vapor recovery path. An inlet port and an outlet port direct vapor from the vapor recovery path to a sensor. The inlet and outlet ports are positioned relative to the flow restrictor for forcing the vapor through the sensor. In this embodiment, a common flow restrictor within the vapor recovery path may accommodate both the vapor sensor and the pressure sensor. If vapor is not being returned in the vapor return path properly, the fuel dispenser may set an alarm condition and/or shut down the fuel dispenser operation. If vapor is not being returned at the proper rate, the vapor pump speed may be adjusted, for example, to bring the vapor return rate to the proper level.

17 Claims, 7 Drawing Sheets

U.S. PATENT DOCUMENTS 5,027,499 A 7/1991 Prohaska ..... 29/595
5,040,576 A 8/1991 Faeth ..... 141/45
5,040,577 A 8/1991 Pope ..... 141/59
5,116,759 A 5/1992 Klainer et al. ..... 435/288
5,129,433 A 7/1992 Faeth ..... 141/45
5,143,258 A 9/1992 Mittermaier ..... 222/73
5,156,199 A 10/1992 Hartsell, Jr. et al. ..... 141/83
5,165,379 A 11/1992 Thompson ..... 123/520
5,195,564 A 3/1993 Spalding ..... 141/1
5,203,384 A 4/1993 Hansen ..... 141/59
5,240,045 A 8/1993 Faeth ..... 141/1
5,244,022 A * 9/1993 Gimby ..... 141/301
5,267,470 A 12/1993 Cook ..... 73/49.7
5,269,353 A 12/1993 Nanaji et al. ..... 141/59
5,323,817 A 6/1994 Spalding ..... 141/1
5,332,008 A 7/1994 Todd et al. ..... 141/5
5,332,011 A 7/1994 Spalding ..... 141/59
5,333,654 A 8/1994 Faeth ..... 141/1
5,333,655 A 8/1994 Bergamini et al. ..... 141/59
5,355,915 A 10/1994 Payne ..... 141/83
5,365,985 A 11/1994 Todd et al. ..... 141/392
5,386,812 A 2/1995 Curran et al. ..... 123/520
5,417,256 A 5/1995 Hartsell, Jr. et al. ..... 141/7
5,450,883 A 9/1995 Payne et al. ..... 141/59
5,452,621 A 9/1995 Aylesworth et al. ..... 73/864.81
5,460,054 A 10/1995 Tran ..... 73/863.61
5,464,466 A 11/1995 Nanaji et al. ..... 95/45
5,500,369 A 3/1996 Kiplinger ..... 435/309.1
5,507,325 A 4/1996 Finlayson ..... 141/83
RE35,238 E 5/1996 Pope ..... 141/59
5,542,458 A 8/1996 Payne et al. ..... 141/7
5,563,339 A 10/1996 Compton et al. ..... 73/64.45
5,563,341 A 10/1996 Fenner et al. ..... 73/335.11
5,568,828 A 10/1996 Harris ..... 141/348
5,571,310 A 11/1996 Nanaji ..... 96/4
5,590,697 A 1/1997 Benjay et al. ..... 141/59
5,592,979 A 1/1997 Payne et al. ..... 141/59
5,625,156 A 4/1997 Serrels et al. ..... 73/863.51
5,626,649 A 5/1997 Nanaji ..... 95/12
5,663,492 A 9/1997 Alapati et al. ..... 73/64.45
5,671,785 A 9/1997 Andersson ..... 141/59
5,720,325 A 2/1998 Grantham ..... 141/59
5,752,411 A 5/1998 Harpster ..... 73/861.04
5,755,854 A 5/1998 Nanaji ..... 95/11
5,780,245 A 7/1998 Maroteaux ..... 435/7.21
5,782,275 A 7/1998 Hartsell, Jr. et al. ..... 141/94
5,803,136 A 9/1998 Hartsell, Jr. ..... 141/7
5,832,967 A 11/1998 Andersson ..... 141/59
5,843,212 A 12/1998 Nanaji ..... 96/4
5,850,857 A 12/1998 Simpson ..... 141/59
5,857,500 A 1/1999 Payne et al. ..... 141/59
5,860,457 A 1/1999 Andersson ..... 141/59
5,868,175 A 2/1999 Duff et al. ..... 141/59
5,878,790 A 3/1999 Janssen ..... 141/59
5,889,202 A 3/1999 Alapati et al. ..... 73/64.45
5,898,108 A 4/1999 Mieczkowski et al. .... 73/118.1
5,911,248 A 6/1999 Keller ..... 141/59
5,913,343 A 6/1999 Andersson ..... 141/59
5,942,980 A 8/1999 Hoben et al. ..... 340/618
5,944,067 A 8/1999 Andersson ..... 141/59
5,956,259 A 9/1999 Hartsell, Jr. et al. .... 364/528.37
5,988,232 A 11/1999 Koch et al. ..... 141/59
5,992,395 A * 11/1999 Hartsell, Jr. et al. ..... 123/516
6,026,866 A 2/2000 Nanaji ..... 141/59
6,037,184 A 3/2000 Matilainen et al. ..... 436/177
6,038,922 A 3/2000 Mauze et al. ..... 73/335.08
6,065,507 A 5/2000 Nanaji ..... 141/59
6,070,453 A 6/2000 Myers ..... 73/40.5 R
6,082,415 A 7/2000 Rowland et al. ..... 141/59
6,102,085 A 8/2000 Nanaji ..... 141/83
6,103,532 A 8/2000 Koch et al. ..... 436/55
6,123,118 A 9/2000 Nanaji ..... 141/4
6,131,621 A 10/2000 Garrard ..... 141/59

* cited by examiner

PRESSURE SENSOR FOR A VAPOR RECOVERY SYSTEM

FIELD OF THE INVENTION

The present invention is directed to a pressure sensor within a vapor recovery system and, more particularly, to a pressure sensor mounted about a flow restrictor within a vapor recovery path.

BACKGROUND OF THE INVENTION

A vapor recovery system captures vapors produced during a fueling operation. The system usually includes a vapor recovery path that extends between a nozzle, used for dispensing fuel, and a fuel storage tank. A vapor recovery pump, or other vacuum creating device, creates a vacuum within the path such that the vapor is pulled into the nozzle end, through the vapor recovery path, and into the underground storage tank. The system prevents the unwanted emissions of hydrocarbon and other potentially harmful gases that may be detrimental to the environment.

To ensure the system is effectively capturing vapors, it is necessary for sensors or other like monitoring equipment to be placed along the vapor recovery path. Governing bodies, such as the California Air Resources Board (CARB), set specific requirements for the amount of vapor captured and returned to the storage tank to comply with the U.S. Federal Clean Air Act Amendments of 1990.

However, many vapor recovery systems cannot recognize if vapor is actually being returned through the fuel dispenser to the underground storage tank. Failure of vapor being returned may be due to the occurrence of a pump failure or a leak along the vapor recovery path. Even though the vapor recovery system may be operational, such a failure or leak may not be detected by the system allowing vapors to escape into the atmosphere.

One manner of providing self-compliant vapor recovery systems is to provide technology to determine if a flow rate exits in the vapor return path when the vapor recovery system is operational. If flow rate does not exist in the vapor return path, vapors are not being recovered. This may be due to a malfunction in the vacuum creating device or a leak in the hose, but, nevertheless vapors are not being recovered as intended.

A vapor flow meter, such as that described in U.S. Pat. No. 5,860,457, entitled "Gasoline Vapor Recovery System and Method of Utilizing Vapor Detection" is one type of device that can be used to measure flow rate of vapor being returned in the vapor return path. However, a vapor flow meter is expensive, can be damaged by the presence of liquid or debris in the vapor stream, and is difficult to access and replace when damaged. The meter should meet certain safety requirements, such as those established by Underwriter's Laboratories (hereinafter, U.L.), since the vapor may be at a flammable level.

Therefore, there exists a need to provide other devices that are less expensive and are easily connected to the vapor recovery return path that can measure flow rates in a vapor recovery return path.

SUMMARY OF THE INVENTION

The present invention is directed to a pressure sensor positioned along a vapor recovery path. In one embodiment, a flow restrictor is positioned along the vapor recovery path. The pressure sensor includes a first input and a second input, with each of the inputs being positioned about the flow restrictor to determine the pressure change.

The flow restrictor may have a variety of structures, including an orifice, laminar flow element, venturi, etc. Within the venturi, the inputs are positioned about the neck, narrowing sections, and vapor recovery path to sense the change in pressure.

Another embodiment of the invention features a vapor sensor positioned adjacent to the flow restrictor. The vapor sensor includes an inlet and an outlet extending from said vapor recovery path for directing vapor through a testing zone. The inlet and outlet of the vapor sensor, and the inputs of the pressure sensor are positioned about the flow restrictor for efficient operation.

The present invention is also directed to a pressure sensor that is mounted to the vapor recovery path. The vapor recovery path has an interior passage for containing vapors and an exterior mounting platform. An aperture extends between the interior passage and the mounting platform. The pressure sensor is mounted to the mounting platform and includes a pressure sensor controller and at least one input. The input includes a first end operatively connected to the pressure sensor controller and a second end sized to extend through the aperture into the interior passage.

In this embodiment, the pressure sensor controller may be mounted within a mounting device, also referred to as a "mount." The mount may have a substantially flat surface that mates with a substantially flat surface of the mounting platform. Fasteners may provide for removably mounting the pressure sensor to the mounting platform.

DETAILED DESCRIPTION OF THE INVENTION

Figure 1:
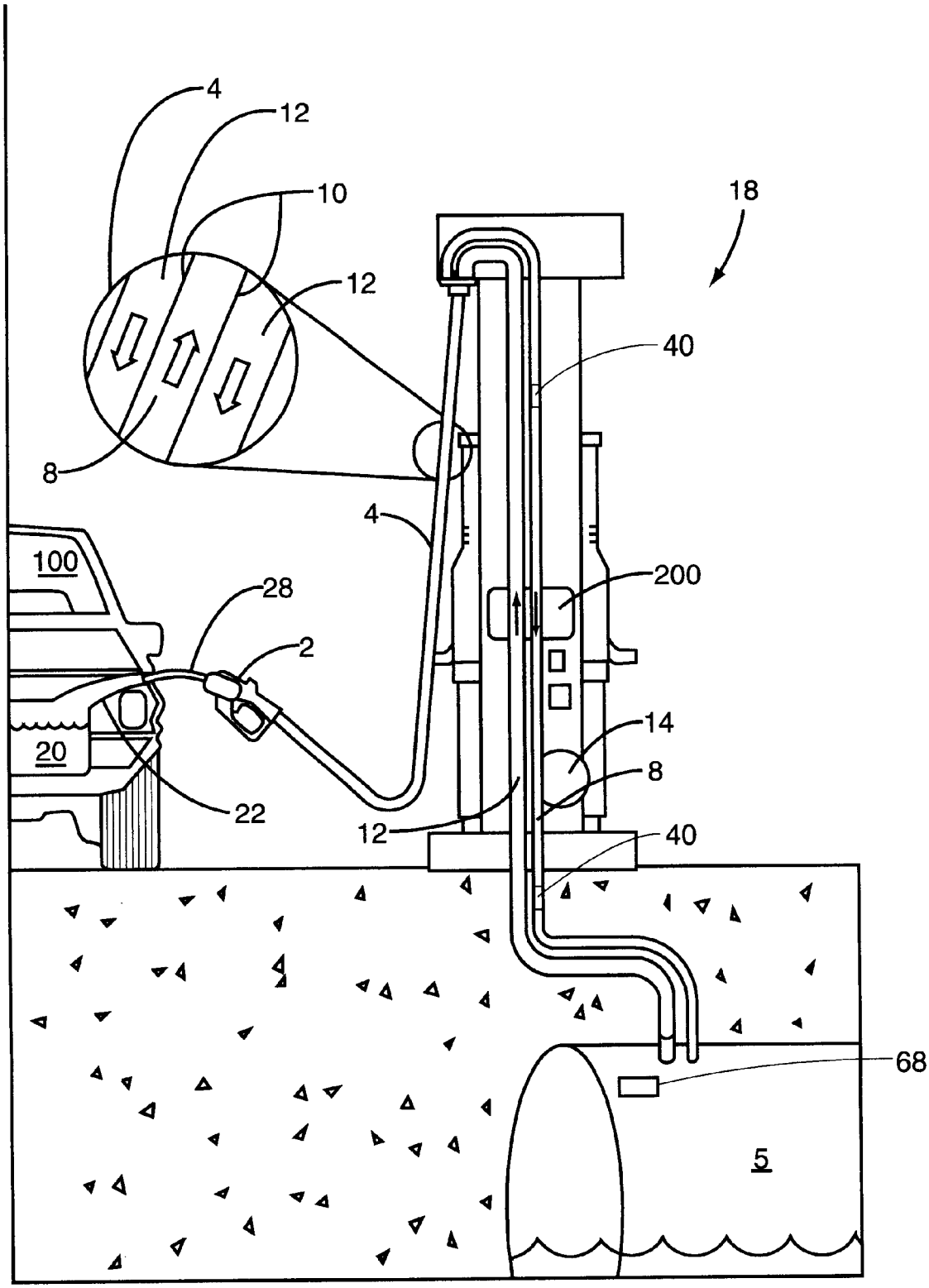
FIG. 1 is a cross-sectional side view of a fuel dispenser having a vapor recovery system.

Referring now to the drawings in general and FIG. 1 in particular, it will be understood that the illustrations are for the purpose of describing a preferred embodiment of the invention and are not intended to limit the invention thereto. As best seen in FIG. 1, in a typical service station, a vehicle 100 is illustrated being fueled from a fuel dispenser or pump 18. A spout 28 of nozzle 2 is shown inserted into a filler pipe 22 of a fuel tank 20 during the refueling of the vehicle 100.

A fuel delivery hose 4 having vapor recovery capability is connected at one end to the nozzle 2, and at its other end to the fuel dispenser 18. As shown by the cutaway view of the interior of the fuel delivery hose 4, a fuel delivery line 12 is formed within the fuel delivery hose 4 for distributing liquid fuel pumped from an underground storage tank 5 to the nozzle 2. A fuel pump 68 delivers the fuel from the underground storage tank 5 to the nozzle 2.

In one embodiment, spout 28 of the nozzle 2 has numerous apertures (not illustrated). The apertures provide an inlet for fuel vapors to enter the vapor recovery path 8 of fuel dispenser 18 from the vehicle's filler pipe 22. As liquid fuel rushes into the fuel tank 20 during the fueling operation, fuel vapors are forced out of the fuel tank 20 through the filler pipe 22. The fuel dispenser's vapor recovery system pulls fuel vapor through the apertures, along the vapor recovery path 8, and ultimately into the underground storage tank 5.

Vapor recovery path 8 transfers fuel vapors expelled from the vehicle's fuel tank 20 to the underground storage tank 5. The fuel delivery hose 4 is depicted as having an internal vapor recovery hose 10 for creating a section of the vapor recovery path 8. The term "vapor recovery path" as used herein refers to the flow path along which vapors recovered during the fueling operation are returned to a storage point. One such storage point is an underground storage tank 5, however, other types of storage points may also include intermediate vapor collection devices. Thus, a device installed in the vapor recovery path 8 may be installed at various positions along the path described above.

Vapor pump 14 creates a vacuum in the vapor recovery path 8 for removing fuel vapor during the fueling operation. The vapor pump 14 may be placed anywhere along the vapor recovery path 8 between the nozzle 2 and the underground fuel storage tank 5. The vapor recovery system using the pump 14 may be any suitable system such as those shown in U.S. Reissue Pat. No. 35,238; and U.S. Pat. Nos. 5,195,564; 5,333,655; or 3,016,928, each of which is incorporated herein by reference. The vapor pump 14 may be either a constant speed or variable speed vapor pump. There may be one vapor pump 14 for each side of a fuel dispenser 18 or one vapor pump 14 for both sides of a fuel dispenser 18.

Figure 2:
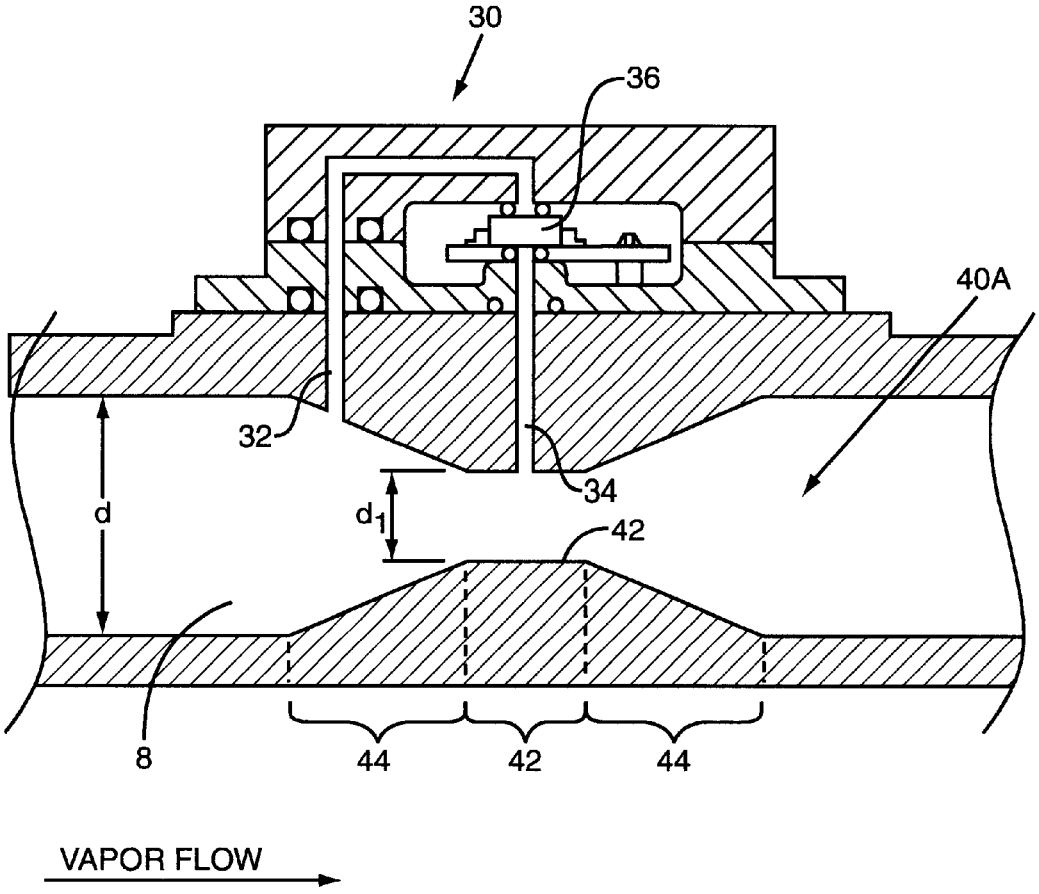
FIG. 2 is a schematic view of a pressure sensor having first and second inputs positioned about a flow restrictor within the vapor recovery path.

FIG. 2 illustrates one embodiment of providing a flow restrictor, generally designated 40, in the vapor recovery path 8 for determining pressure in the vapor recovery path 8. The flow rate is related to the pressure difference and may be determined using the Bernoulli equation that is well known in the art that states the total energy of a fluid flowing without friction losses in a pipe is constant. The total energy possessed by the fluid is the sum of its pressure, and kinetic and potential energies. U.S. Pat. Nos. 4,508,127; 5,671,785; and 5,860,457 discuss this concept and are each incorporated herein by reference in their entirety.

Figure 3:
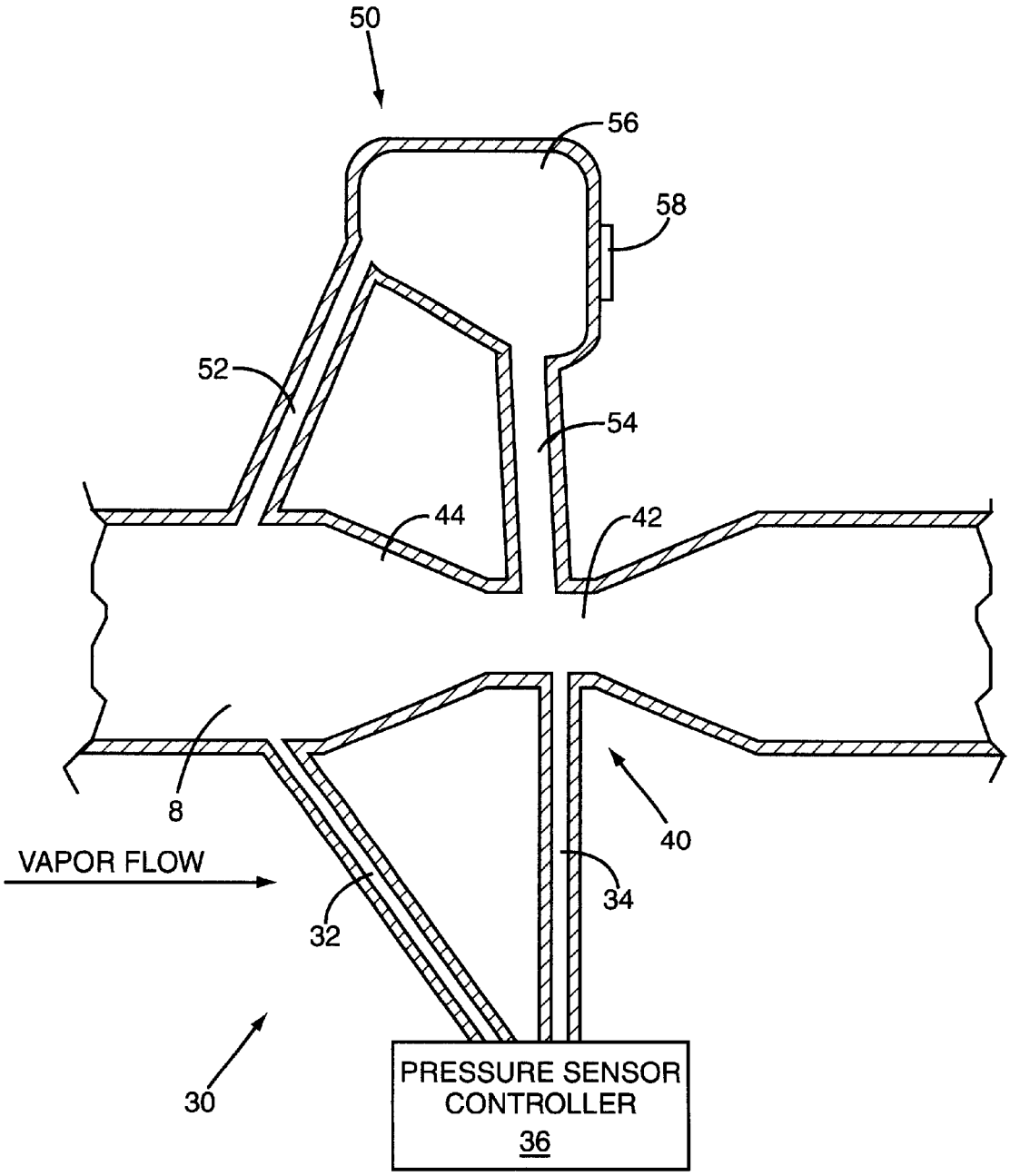
FIG. 3 is a schematic view of a vapor recovery path having a flow restrictor about which are mounted a vapor sensor having an inlet and outlet and a pressure sensor having first and second inputs.

Flow restrictor 40 may take a variety of forms including a venturi, baffle, laminar flow element, orifice plate, aperture controlled orifice, or other like device, each of which is contemplated by the present invention. Flow restrictor 40 may be positioned at a variety of positions along the vapor recovery path 8 between the fuel delivery hose 4 and the storage tank 5. Additionally, there may be more than one flow restrictor 40 positioned along the vapor recovery path 8, such as illustrated in FIG. 1 with a flow restrictor 40 positioned upstream and downstream of the vapor pump 14. FIGS. 2 and 3 illustrate embodiments featuring a venturi 40A. Venturi 40A includes a neck section 42 having a reduced diameter, bounded by narrowing sections 44 having a diameter d1 that lead into the vapor recovery path 8 that has a larger diameter "d."

Pressure sensor 30 includes a first input 32 and a second input 34 extending from a pressure sensor controller 36. Each input 32, 34 is positioned within the vapor recovery path 8 and signals to the pressure sensor controller 36 to determine the extent of vapor pressure change between the inputs. In one embodiment, inputs 32, 34 are passageways to either side of a differential pressure sensor, such as Motorola MPXV 5004G6U. As illustrated in FIG. 2, inputs 32, 34 may be spaced at locations having different diameters along the flow restrictor 40 and vapor recovery path 8 to determine the pressure change. Within the venturi 40A embodiment, inputs 32, 34 are spaced about the vapor recovery path 8 having a diameter d, the narrowing sections 44 having a diameter d1, and the neck 42. First input 32 may be positioned either upstream or downstream of the second input 34.

Pressure sensor controller 36 may further signal the vapor pressure to a main dispenser controller 200 which monitors the vapor recovery process and controls the rate of the vapor pump 14 to ensure adequate vapor removal. Pressure sensor controller 36 may also communicate the signal to a station controller or other external controller (not illustrated) that monitors the vapor recovery system.

FIG. 3 illustrates the pressure sensor 30 and a vapor sensor 50 positioned on the vapor recovery path 8 about a common flow restrictor 40. Vapor sensor 50 includes an inlet 52, outlet 54, and a sensing chamber 56. Vapor is drawn from the vapor recovery path 8 into the inlet 52 where it is directed into the sensing chamber 56. A sensing device 58 positioned within the sensing chamber 56 analyzes the vapor and determines a concentration level which may be signaled to the main dispenser controller 200, or a destination outside of the fuel dispenser 18. Sensing device 58 may be either a direct of indirect sensor, and may sense hydrocarbons, oxygen, or other gases produced during the fueling process. Outlet 54 directs the vapor from the sensing chamber 56 back into the vapor recovery path 8. The positioning of the vapor sensor 50 relative to the flow restrictor 40 assists in directing vapor through the inlet 52, sensing chamber 56, and outlet 54. A vapor sensor positioned along a vapor recovery path 8 and along a flow restrictor 40 is discussed in U.S. patent Application Ser. No. 09/188,860 filed Nov. 9, 1998 entitled "Hydrocarbon Vapor Sensing" and continuation-in-part application Ser. No. 09/651,376 that is currently co-pending with this application, both of which are incorporated herein by reference in its entirety.

A pressure sensor 30 is also mounted about the flow restrictor 40 for determining the pressure change within the vapor recovery path 8. Inputs 32, 34 are operatively connected to a pressure sensor controller 36 and operate as previously described.

Both the vapor sensor inlet 52 and outlet 54, and the pressure sensor inputs 32, 34 may be positioned at a variety of orientations about the flow restrictor 40. The present invention is advantageous because a single flow restrictor 40 may accommodate both sensors 30, 50. As illustrated in FIG. 3, vapor sensor inlet 52 opens into the vapor recovery path 8 at a position having a larger diameter then the location of outlet 54 which is positioned at the neck 42. One pressure sensor input 32 is positioned within the vapor recovery path 8 at a point having a larger diameter than the second input 34 which is positioned at the neck 42. Pressure sensor inputs 32, 34, and inlet 52 and outlet 54 may have a variety of orientations. In one embodiment, pressure sensor input 34 is directed to the low pressure part of the pressure sensor controller 36 while input 32 is directed to the high pressure side. The pressure sensor 30 measures the pressure difference between inputs 32 and 34 which is proportional to flow while vapor sensor 50 uses the pressure difference to create a bypass flow through the sensing chamber 56.

Placing both a vapor sensor 50 and pressure sensor 30 within the vapor recovery path 8 provides for determining the volume of vapor being returned through the vapor recovery path 8. The volume of vapor is the flow rate through the vapor recovery path 8 times the concentration of the vapor. Another system for determining the volume of vapor is disclosed in U.S. patent application Ser. No. 09/442, 263 entitled "Vapor Flow and Hydrocarbon Concentration Sensor for Improved Vapor Recovery in Fuel Dispensers" filed Nov. 11, 1999, herein incorporated by reference in its entirety. Dispenser controller 200 may be programmed to monitor the vapor volume flowing through the vapor recovery path 8.In one embodiment if the vapor volume is not within a predetermined range that has been programmed within the controller 200, an error condition may occur in which controller 200 sends a signal to a monitoring location, the fuel dispenser is shut down, or controller adjusts the rate of the vapor pump 14.

The pressure sensor 30 may be removably mounted to the vapor recovery path such that it may be removed in the event of failure, servicing requirements, or other. Preferably, pressure sensor 30 is positioned within the fuel dispenser 18 at a position to be accessed by a service technician. This includes the area of the vapor recovery path 8 between the fuel deliver hose 4 and a bottom of the fuel dispenser 18.

Figure 4:
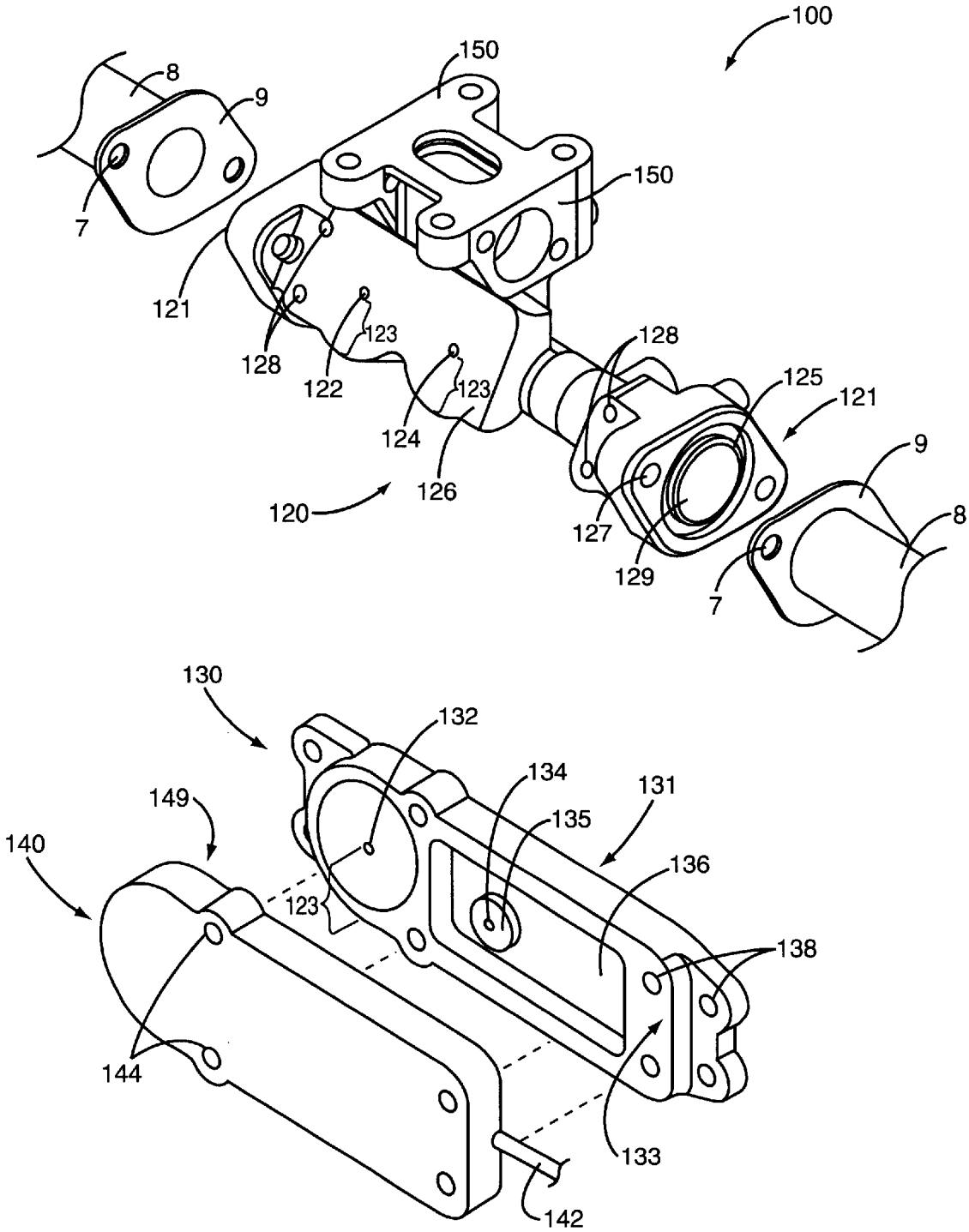
FIG. 4 is a partial perspective exploded view of a mounting platform positioned on an exterior of the vapor recovery path and a top side of a pressure sensor housing.

FIG. 4 illustrates one embodiment of a removable section 100 that is mounted within the vapor recovery path 8. The removable section 100 includes three components including a vapor path section 120, intermediate mounting section 130, and a pressure sensor mount 140. The removable section 100 is preferably as small as possible to accommodate installation within a variety of fuel dispensers. The entire removable section 100 may be removed and replaced within the vapor recovery path 8, or individual components can be removed and replaced as needed. In one embodiment, the removable section 100 is constructed in accordance with the requirements established in U.L. 886 and 1203, each of which is incorporated by reference in their entirety.

Vapor path section 120 includes a vapor recovery passage 129 extending through an interior section that aligns with the vapor recovery path 8. Couplings 121 at each side of the vapor path section 120 mate with receivers 9 on the vapor recovery path 8 for mounting the section 120. O-rings 125 or other gaskets may be positioned on the couplings 121 to press against the receiver 9 and prevent vapor leakage. In one embodiment, coupling 121 mates with receiver 9 only in the correct orientation to ensure the removable section 100 is properly mounted. One manner of providing proper alignment is to position fastener holes 127 such that they align with receiver fastener holes 7 during proper alignment.

A mounting platform 126 is positioned adjacent to the vapor recovery passage 129 for mounting the pressure sensor 30. In one embodiment, mounting platform 126 is substantially smooth and flat according to requirements established in U.L. 886 and 1203. Apertures 122, 124 are spaced about the mounting platform 126 for receiving the pressure sensor first input 32 and second input 34. Apertures 122, 124 extend through the vapor path section and open into the vapor recovery passage 129. Mounting apertures 128 are positioned about the vapor path section 120 for receiving fasteners for attaching the other components 130, 140. A vapor sensor mount 150 is further positioned on the vapor path section 120 and includes the vapor sensor 50.

Intermediate mounting section 130 mounts onto the vapor path section 120 as a first side 131 mates against the mounting platform 126. In one embodiment, first side 131 is substantially smooth and flat to seat tightly against the mounting platform 126. Apertures 132, 134 align with apertures 122, 124 respectively within the vapor path section 120 through which the pressure sensor inputs 32, 34 extend. Recess 136 extends within a second side 133. A raised platform 135 is positioned within the recess 136 for receiving one of the pressure sensor inputs 32, or 34. Holes 138 are positioned about the intermediate mounting section 130 for receiving fasteners for mounting to the vapor path section 120 and pressure sensor mount 140.

Figure 5:
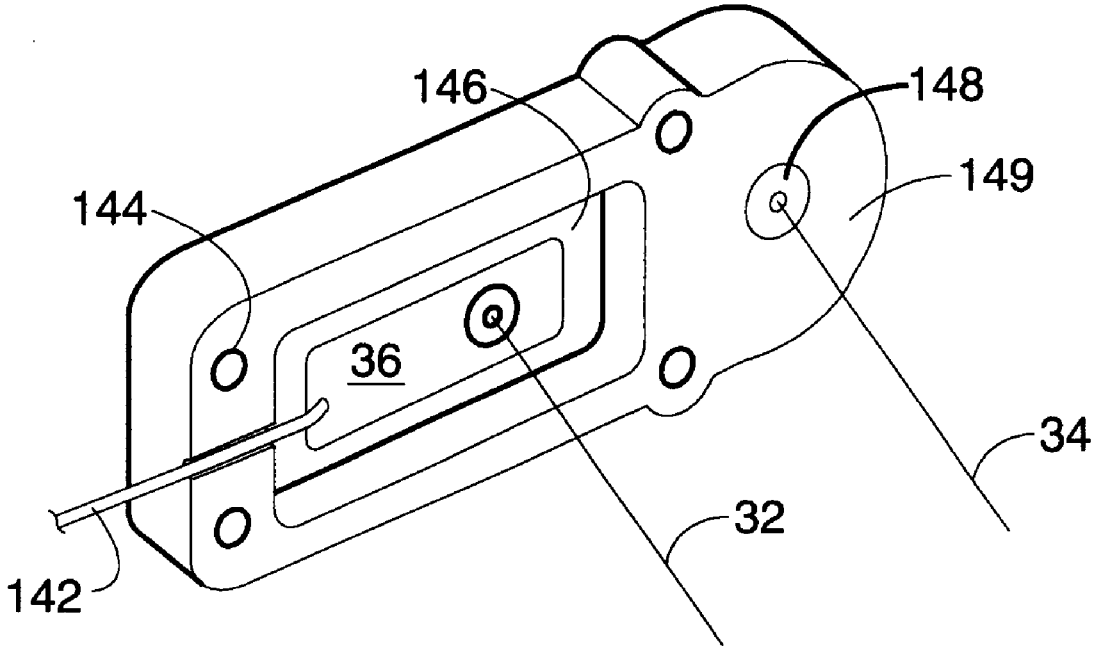
FIG. 5 is a perspective view of a bottom side of the pressure sensor housing and pressure sensor.

Pressure sensor mount 140 contains the pressure sensor 30. FIG. 4 illustrates a first side having holes 144 for receiving fasteners for mounting to the intermediate mounting section 130 and vapor path section 120. Lead 142 extends through the pressure sensor mount 140 and operatively connects to the main dispenser controller 200 or other processor for receiving the pressure information. FIG. 5 illustrates a second side of the pressure sensor mount 140 and includes a chamber 146 for containing the pressure sensor controller 36. Aperture 148 is sized such that input 34 can extend through and mount through apertures 132, 122 and into the vapor recovery passage 123. Mounting surface 149 abuts against the intermediate mounting section.

O-rings and other gaskets (not illustrated) are positioned between the components 120, 130, 140 to properly seat them together, and prevent any potential leaks. In one embodiment, removable section 100 is constructed of a U.L. approved material, such as aluminum. To further reduce any potential flame path, surfaces 126, 131, and 149 may be designed to meet U.L. flame path requirements as specified by U.L. 886 and 1203. Additionally, in one embodiment, the apertures 122, 124 within the vapor path section 120, and apertures 132, 134 within the intermediate section 130 align forming a bore that is at least about 0.375 inches from the outside edge of the vapor path section 120, and intermediate mounting section 130. This distance is illustrated by element number 123. In one embodiment, the distance between 120, 130, and 140 when mounted together may also be less than about 0.0015 inches wide.

Figure 6:
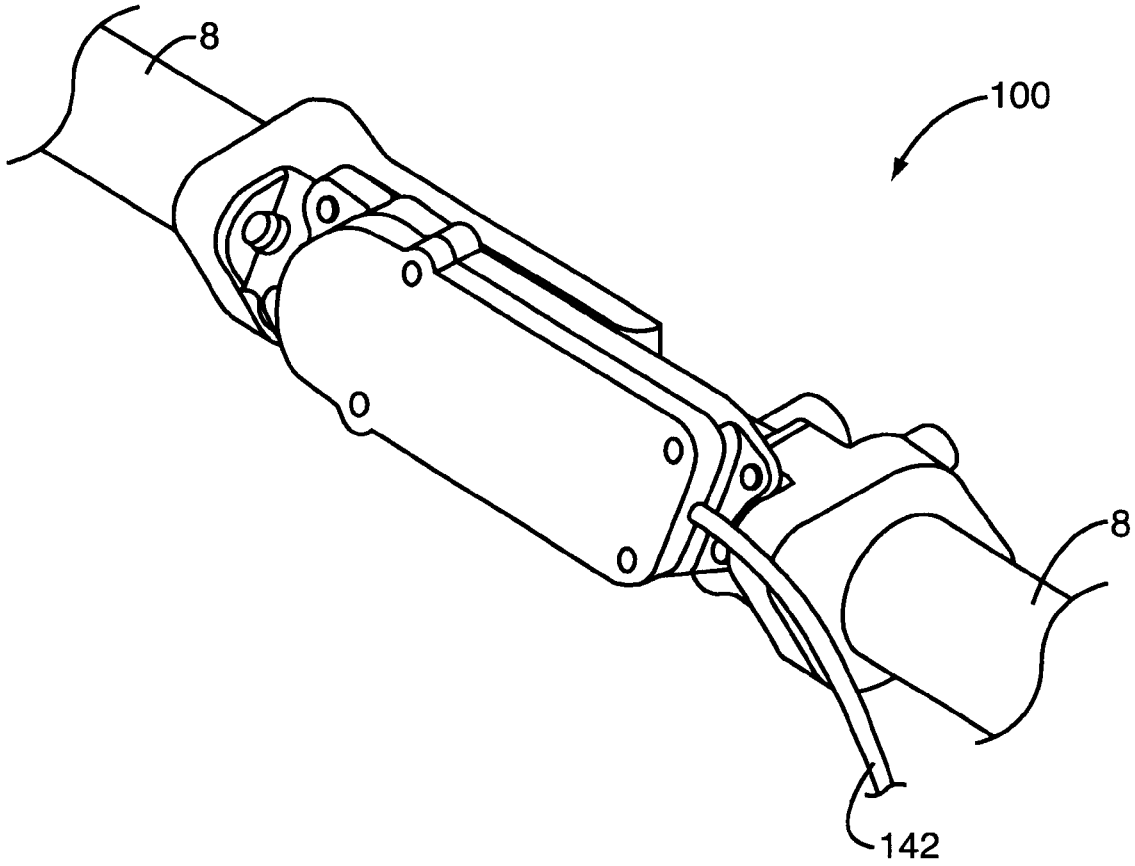
FIG. 6 is a perspective view of a pressure sensor mounted to the vapor recovery path.

FIGS. 4 and 5 illustrate one embodiment of a removable section 100 and pressure sensor 30 that is contemplated by the present invention. Various other embodiments are also contemplated in which the pressure sensor 30 may be mounted to the vapor recovery path 8. FIG. 6 illustrates another embodiment in which pressure sensor 30 is mounted into an integral section of the vapor recovery path 8. The vapor recovery path 8 includes a mounting platform 126 to which pressure sensor 30 is mounted. Inputs extend through openings within the vapor recovery passage to access the interior space and determine the vapor pressure. Removal is accommodated by removing fasteners and removing the pressure sensor from the vapor recovery path 8. Only pressure sensor 30 is removed and replaced, without removing any sections of the vapor recovery path 8.

Figure 7:
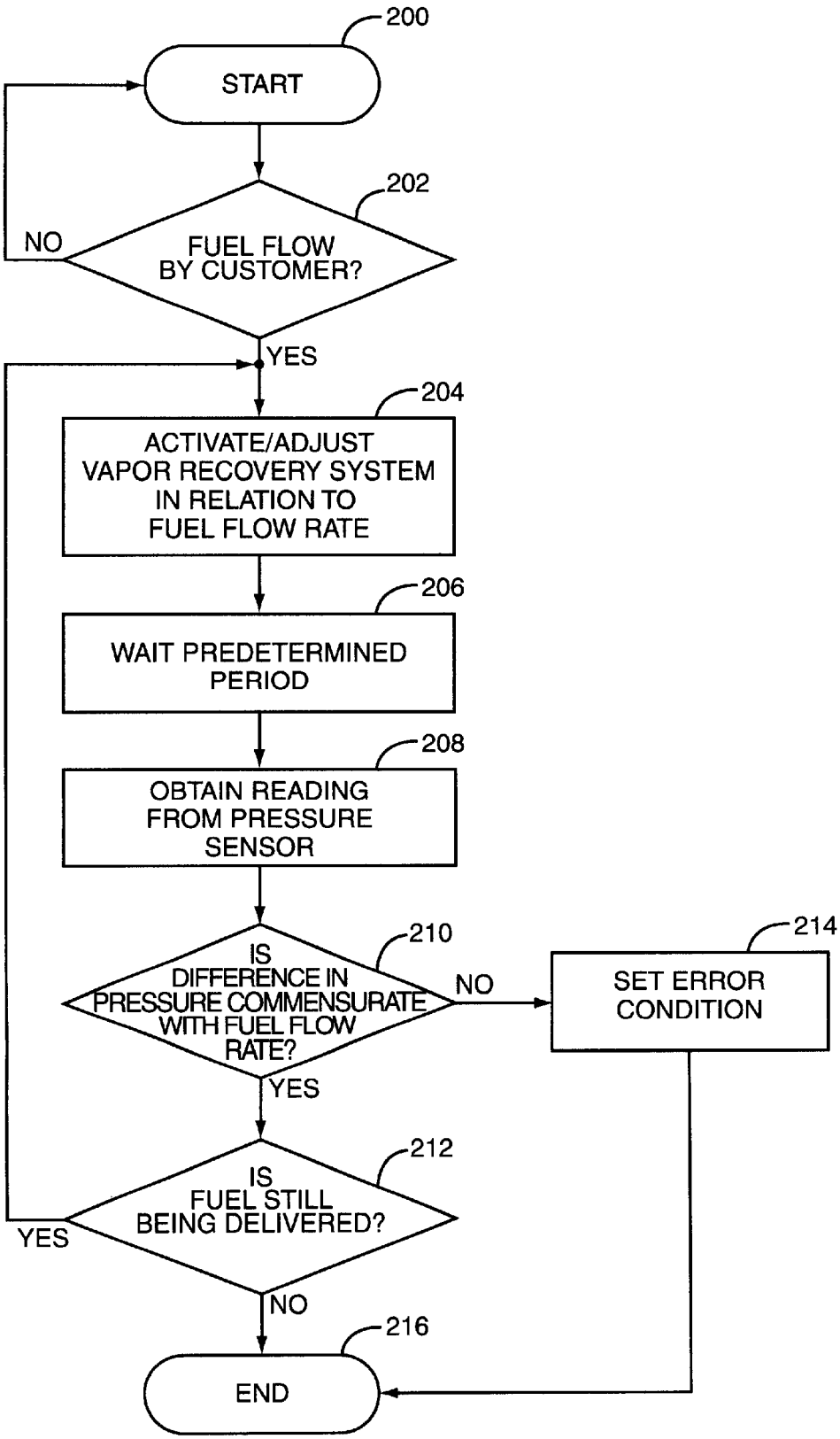
FIG. 7 is a flowchart illustration the steps comprising sensing the pressure within the vapor recovery path in accordance with one embodiment of the present invention.

FIG. 7 illustrates a flowchart showing one embodiment of operation of the vapor recovery system when using the pressure sensor 30 of the present invention to determine if vapor is being returned through the vapor recovery return path 8. The process starts (block 200), and the main dispenser controller 200 determines if fuel flow has begun in the form of a customer engaging a nozzle 2 (block 202) or by the presence of pulses from a fuel flow meter (not illustrated). If fuel flow has not begun, the process waits (block 202).

If fuel flow has begun, the main dispenser controller 200 turns on the vapor pump 14 to create a vacuum in the vapor recovery return path 8 commensurate with the fuel flow rate in order to efficiently capture the vapors expelled from the vehicle fuel tank 20 (block 204). The main dispenser controller 200 waits a predetermined period of time (block 206), and then accesses the pressure sensor 30 reading to determine if flow exists in the vapor recovery return path 8 (block 208). However, the system may still be operable if the dispenser controller 200 does not wait a predetermined amount of time. If the pressure sensor 40 is such that the vapor flow rate is not commensurate with fuel flow rate being delivered through the nozzle 2 (block 210), the main dispenser controller 200 sets an error condition (block 214), and the process ends (block 216). The error condition may be a variety of actions, including setting an alarm condition at the fuel dispenser 18, sending an alarm to a site controller (not shown) that may be in communication with the fuel dispenser 18, or sending an alarm remotely from the service station, either through the fuel dispenser 18 or through a site controller. In addition, the fuel dispenser 18 may turn off the vacuum creating device, such as the vapor pump 14, or the fuel dispenser 8, so that fuel can no longer be delivered to a vehicle until the fuel dispenser 8 is serviced by a technician. If the vapor flow rate is marginally low or high in proportion to the fuel flow rate, the controller may signal the vapor pump 14 to speed up or slow down in order to adjust the vapor flow to the proper rate.

If the flow rate in the vapor recovery return path 8 is commensurate with the fuel flow being delivered into the fuel tank 20, the main dispenser controller 200 determines if the customer has stopped dispensing (i.e. disengaged the nozzle 2) (block 212). If so, the process ends (block 216). If not, the process continues to adjust the vapor pump 14 commensurate with the fuel flow rate (block 204), and the process continues.

The present invention may be carried out in other specific ways than those herein set forth without departing from the spirit and essential characteristics of the invention. In one embodiment, the predetermined vapor flow rate or the vapor volume through the vapor recovery path 8 is determined through empirical testing and stored within the main dispenser controller 200 or other memory location. The present embodiments are, therefore, to be considered in all respects as illustrative and not restrictive, and all changes coming within the meaning and equivalency range of the appended claims are intended to be embraced therein.

What is claimed is:

1. A system for measuring vapor comprising:

a) a vapor recovery path;

b) a flow restrictor positioned along said vapor recovery path;

c) a pressure sensor having first and second inputs for measuring a pressure change within said vapor recovery path, one of said inputs being positioned at said flow restrictor; and d) a vapor sensor having an inlet and an outlet extending from said vapor recovery path for directing vapor through a testing zone, one of said inlets and outlets extending from said vapor recovery path at said flow restrictor.

2. The system of claim 1, wherein said flow restrictor includes a section having a reduced cross-sectional area, one of said pressure sensor inputs and one of said vapor sensor inlet or outlet being positioned at said section.

3. The system of claim 1, wherein said flow restrictor is a venturi having a neck section, one of said pressure sensor inputs and one of said vapor sensor inlet or outlet being positioned at said neck section.

4. The system of claim 1, wherein one of said vapor sensor inputs and one of said pressure sensors inlet or outlet are positioned upstream of said flow restrictor.

5. The system of claim 1, wherein one of said vapor sensor inputs and one of said pressure sensors inlet or outlet are positioned downstream of said flow restrictor.

6. The system of claim 1, wherein said vapor sensor and said pressure sensor determine a vapor volume.

7. The system of claim 6, wherein when said vapor volume is outside of a predetermined range, an error condition occurs.

8. A device for measuring pressure within a vapor recovery system comprising:

a) a vapor recovery path having an upstream end and a downstream end;

b) a flow restrictor positioned along said vapor recovery path between said upstream and downstream ends for creating a change in pressure within said vapor recovery path; and c) a pressure sensor having a first input and a second input, one of said inputs being operatively connected to said vapor recovery path at said flow restrictor, said inputs measuring a pressure change within said vapor recovery path to determine a vapor recovery rate.

9. The device of claim 8, wherein said flow restrictor is a venturi placed within said vapor recovery path.

10. The device of claim 9, wherein one of said inputs is positioned within a neck of said venturi.

11. The device of claim 8, wherein one of said pressure sensor inputs is positioned at said flow restrictor.

12. The device of claim 11, wherein one of said pressure sensor inputs is positioned within said vapor recovery path at a point upstream of said flow restrictor.

13. The device of claim 11, wherein one of said pressure sensor inputs is positioned within said vapor recovery path at a point downstream of said flow restrictor.

14. The device of claim 11, wherein one of said inputs is positioned at a point along said flow restrictor having the smallest area through which vapor passes.

15. The device of claim 8, further including a controller operatively connected to said first and second inputs.

16. A fuel delivery and vapor recovery system comprising:

a) a fuel delivery path;

b) a vapor recovery path having an upstream end and a downstream end;

c) a vapor pump positioned along said vapor recovery path for creating a vacuum for drawing vapors into said upstream end to said downstream end;

d) a flow restrictor positioned along said vapor recovery path between said upstream and downstream ends for creating a change in pressure within said vapor recovery path; and e) a pressure sensor having a first input and a second input, one of said inputs being operatively connected to said vapor recovery path at said flow restrictor, said inputs measuring a pressure change within said vapor recovery path.

17. A fuel delivery and vapor recovery system comprising:

a) a fuel delivery path;

b) a vapor recovery path having an upstream end and a downstream end;

c) a vapor pump positioned along said vapor recovery path for creating a vacuum for drawing vapors into said upstream end to said downstream end;

d) a flow restrictor positioned along said vapor recovery path between said upstream and downstream ends for creating a change in pressure within said vapor recovery path;

e) a pressure sensor having first and second inputs for measuring a pressure change within said vapor recovery path, one of said inputs being positioned at said flow restrictor; and f) a vapor sensor having an inlet and an outlet extending from said vapor recovery path for directing vapor through a testing zone, one of said inlet and outlet extending from said vapor recovery path at said flow restrictor.

* * * * *